US011434592B2

(12) United States Patent
Mahadevan

(10) Patent No.: US 11,434,592 B2
(45) Date of Patent: Sep. 6, 2022

(54) SEWING STITCH LENGTH ADJUSTMENT MECHANISMS

(71) Applicant: Hamer-Fischbein LLC, Statesville, NC (US)

(72) Inventor: Pradeep Mahadevan, Mooresville, NC (US)

(73) Assignee: Hamer-Fischbein LLC, Statesville, NC (US)

( * ) Notice: Subject to any disclaimer, the term of this patent is extended or adjusted under 35 U.S.C. 154(b) by 959 days.

(21) Appl. No.: 16/152,798

(22) Filed: Oct. 5, 2018

(65) Prior Publication Data

US 2019/0106822 A1 Apr. 11, 2019

Related U.S. Application Data

(60) Provisional application No. 62/569,045, filed on Oct. 6, 2017.

(51) Int. Cl.
*D05B 27/02* (2006.01)
*D05B 63/00* (2006.01)
(Continued)

(52) U.S. Cl.
CPC ..... *D05B 63/00* (2013.01); *D05B 49/04* (2013.01); *D05B 57/08* (2013.01); *D05B 63/04* (2013.01)

(58) Field of Classification Search
CPC ..... D05B 27/02–08; D05B 27/24
See application file for complete search history.

(56) References Cited

U.S. PATENT DOCUMENTS 1,574,270 A 2/1926 Weis
2,143,681 A * 1/1939 Strain ..... D05C 15/24 112/80.55
(Continued)

FOREIGN PATENT DOCUMENTS

EP 1388601 A2 2/2004
JP S51-30049 A 3/1976
(Continued)

OTHER PUBLICATIONS

International Searching Authority, Invitation to Pay Additional Fees for Application No. PCT/US2018/054561, dated Nov. 30, 2018, 12 pages, European Patent Office, Netherlands.
(Continued)

*Primary Examiner* — Nathan E Durham
(74) *Attorney, Agent, or Firm* — Alston & Bird LLP

(57) ABSTRACT

The length of a sewing machine stitch is adjustable by varying the effective length of a first bar of a multi-bar linkage operably secured to a feed dog of the sewing machine. The effective length of the first bar is defined between an anchor point and a pivot point, with the pivot point being secured to a slider configured for movement along the length of the first bar. The slider comprises a pinion gear configured to engage a gear rack of the first bar, such that rotation of the pinion gear causes movement of the slider and the pivot point relative to the anchor point. Moreover, to accommodate the adjustable stitch length, the sewing machine additionally comprises an adjustable looper thread eyelet configured to adjust the length of the looper thread path to accommodate increased tension or slack in the looper thread due to the changed stitch length.

9 Claims, 14 Drawing Sheets

(51) Int. Cl.

| | |
|---|---|
| ***D05B 63/04*** | (2006.01) |
| ***D05B 49/04*** | (2006.01) |
| ***D05B 57/08*** | (2006.01) |

(56) References Cited

U.S. PATENT DOCUMENTS

| | | | | | |
|---|---|---|---|---|---|
| 2,311,184 | A | | 2/1943 | James | |
| 2,711,145 | A | | 6/1955 | Alessandro | |
| 2,771,848 | A | | 11/1956 | Nicholaus et al. | |
| 3,326,157 | A | | 6/1967 | Hayes et al. | |
| 3,357,384 | A | | 12/1967 | Washburn | |
| 3,494,315 | A | * | 2/1970 | Washburn | D05B 65/06 112/287 |
| 3,578,769 | A | | 5/1971 | Seaman | |
| 3,611,817 | A | | 10/1971 | Smith et al. | |
| 3,903,821 | A | | 9/1975 | Marforio | |
| 3,941,068 | A | | 3/1976 | Washburn | |
| 4,027,609 | A | | 6/1977 | Kerr | |
| 4,303,031 | A | | 12/1981 | Graham | |
| 4,311,105 | A | | 1/1982 | Buzz | |
| 4,444,142 | A | * | 4/1984 | Meier | D05B 27/02 112/315 |
| 4,674,426 | A | | 6/1987 | Kasuda et al. | |
| 4,821,661 | A | | 4/1989 | Brownlee | |
| 5,014,635 | A | | 5/1991 | Ochi et al. | |
| 5,052,317 | A | * | 10/1991 | Schips | D05B 37/06 112/130 |
| 5,152,237 | A | | 10/1992 | Block et al. | |
| 5,182,999 | A | | 2/1993 | Dietl | |
| 5,293,829 | A | | 3/1994 | Mu | |
| 5,299,518 | A | * | 4/1994 | Dusch | D05B 27/02 112/323 |
| 5,313,900 | A | | 5/1994 | Rendahl et al. | |
| 5,333,565 | A | | 8/1994 | Frye | |
| 5,383,418 | A | | 1/1995 | Block et al. | |
| 5,553,563 | A | | 9/1996 | Schopf | |
| 5,732,640 | A | | 3/1998 | Mizusaki et al. | |
| 5,743,198 | A | | 4/1998 | Yamanaka et al. | |
| 5,875,724 | A | | 3/1999 | Ito | |
| 6,499,415 | B1 | | 12/2002 | Grant et al. | |
| 9,506,174 | B2 | | 11/2016 | Tseng | |
| 2005/0178307 | A1 | | 8/2005 | Frazer et al. | |
| 2017/0121878 | A1 | | 5/2017 | Koike et al. | |

FOREIGN PATENT DOCUMENTS

| | | | |
|---|---|---|---|
| JP | S57-143083 | U | 9/1982 |
| JP | S62-249691 | A | 10/1987 |
| WO | WO 2005/098120 | A1 | 10/2005 |

OTHER PUBLICATIONS

International Searching Authority, International Search Report for Application No. PCT/US2018/054561, dated Jan. 22, 2019, 19 pages, European Patent Office, Netherlands.

* cited by examiner

SEWING STITCH LENGTH ADJUSTMENT MECHANISMS

CROSS-REFERENCE TO RELATED APPLICATIONS

This patent application claims priority from U.S. Provisional Appl. Ser. No. 62/569,045 filed Oct. 6, 2017, which is incorporated herein by reference in its entirety.

BACKGROUND

A single sewing machine can be used for sewing a variety of materials, such as fabrics, bag closures, and/or the like. The subset of sewing machines used in industrial settings to sew bag closures for produce bags, grain bags, pet or livestock food bags, and/or the like are generally configured for sewing through bag material, such as multi-ply paper, netting, and/or other bagging materials. Given the similarities in usage for industrial sewing machines, the mechanical workings of these sewing machines may be identical, with small user-adjustable features for accommodating differences between materials and needed stitch characteristics for closing different bag types.

The most notable difference in stitch characteristics between various bag closures is often the stitch length, which directly impacts the "tightness" of the closure and the speed at which the bags may be sewn closed. A shorter stitch length creates a tighter seal that prevents grains or other small-size particulate materials from seeping through the closure, while a longer stitch length decrease the amount of time needed to seal a bag (because fewer stitches are required for a given bag). A sewing machine of this type used in a packaging facility may be required to have a first production run for a type of material with one size of particulate, and then switch to a second production run for a type of material having a second size of particulate. Thus, for a packaging facility to run efficiently, the sewing machine stitch length is advantageously changed between production runs to provide the longest (and thus fastest) stitch length that does not allow excess particulate materials to seep through the stitch chain.

Because of this, a need exists for user-friendly mechanisms enabling precise and quick adjustments to sewing machines to change the created stitch length. Moreover, a need constantly exists for sewing machine stitch length adjustments having a wider range of possible stitch lengths that may be created by a single sewing machine.

BRIEF SUMMARY

Various embodiments are directed to a stitch length adjustment mechanism for a sewing machine that provides a holding-force against unintentional movement of the stitch length adjustment mechanism during adjustment. In certain embodiments, the stitch length adjustment mechanism comprises a multi-bar linkage configured to move a material feed dog, the multi-bar linkage having at least one bar having an adjustable effective length controllable by a rack-and-pinion adjustment mechanism and having a holding spring configured to impede unintentional movement of the pinion relative to the rack.

Moreover, certain embodiments are directed to a looper thread tension adjustment mechanism configured to accommodate varying stitch length adjustments to ensure that the looper thread retains an optimal tension during sewing machine movement, regardless of the stitch length selected by a user. The looper thread tension adjustment mechanism comprises an adjustable looper thread eyelet that may be moved to increase or decrease the overall looper thread path length and to prevent undesirable looper thread whipping that may be caused by low looper thread tension.

Certain embodiments are directed to a sewing machine looper thread mechanism comprising: a reciprocating looper arm configured to tie a locking stitch with a looper thread and a needling thread; and an adjustable take-up eyelet secured relative to an exterior surface of the sewing machine; wherein the adjustable take-up eyelet is configured to redirect a looper thread from a first thread direction extending from a looper thread source to a second thread direction extending to the reciprocating looper arm; and wherein the adjustable take-up eyelet is configured for movement to adjust the length of the looper thread path between the looper thread source and the reciprocating looper arm.

In certain embodiments, the looper thread path extends at least substantially linearly from the reciprocating looper arm to a distal end of the adjustable take-up eyelet, and wherein the adjustable take-up eyelet is configured for movement to adjust a linear distance between the distal end of the adjustable take-up eyelet and the reciprocating looper arm. Moreover, in certain embodiments the adjustable take-up eyelet comprises: an elongated planar medial portion having a face surface and defining a linear adjustment slot extending through the face surface, wherein the adjustment slot is configured to slide relative to one or more fasteners securing the adjustable sewing machine looper thread take-up eyelet relative to the sewing machine; an angled base portion on a base end of the elongated planar medial portion, wherein the angled base portion has a base guide hole extending therethrough, and the angled base portion is angled relative to the face surface; and a skew distal end portion on a distal end of the elongated planar medial portion, wherein the skew distal end portion has a distal guide hole extending therethrough, and the skew distal end portion is skewed about an axis at least substantially aligned with the length of the elongated planar medial portion. In certain embodiments, a linear portion of the looper thread path extends between the base guide hole and the distal guide hole. In various embodiments, the looper thread path turns between the linear portion of the looper thread path extending between the base guide hole and the distal guide hole to a second at least substantially linear portion extending between the distal guide hole and the reciprocating looper arm. Moreover, the adjustable take-up eyelet is movable in certain embodiments in a direction parallel with the linear portion of the looper thread path.

Various embodiments are directed to an adjustable sewing machine looper thread take-up eyelet comprising: an elongated planar medial portion having a face surface and defining a linear adjustment slot extending through the face surface, wherein the adjustment slot is configured to slide relative to one or more fasteners securing the adjustable sewing machine looper thread take-up eyelet relative to a sewing machine; an angled base portion on a base end of the elongated planar medial portion, wherein the angled base portion has a base guide hole extending therethrough, and the angled base portion is angled relative to the face surface; and a skew distal end portion on a distal end of the elongated planar medial portion, wherein the skew distal end portion has a distal guide hole extending therethrough, and the skew distal end portion is skewed about an axis at least substantially aligned with the length of the elongated planar medial portion. In various embodiments, a linear looper thread path extends between the base guide hole and the distal guide hole.

Moreover, certain embodiments are directed to a sewing machine stitch length adjustment mechanism, comprising: a multi-bar linkage operatively secured to a feed dog movement mechanism, wherein the multi-bar linkage is configured to control a feed dog movement path length, and wherein the multi-bar linkage comprises: a first bar having an adjustable effective length between an anchor point and a pivot point; and a second bar extending between the pivot point and the feed dog slider mechanism; and wherein the first bar comprises a retaining spring configured to retain a selected location of the pivot point relative to the anchor point.

In various embodiments, the first bar comprises a rack and pinion adjustment mechanism configured to adjust the location of the pivot point relative to the anchor point. Moreover, the first bar may comprise: a rigid bar member having a slot defined therein and having a gear rack defined on a first side of the slot; a slider configured for movement within the slot, the slider having the pivot point secured thereto and having a rotatable pinion configured to engage the gear rack on the first side of the slot; and wherein rotation of the pinion relative to the gear rack causes the slider to move along a length of the slot. Moreover, the first bar may additionally comprise a retaining spring secured relative to a second side of the slot, wherein the retaining spring is configured to apply a retaining force to engage the slider with the first side of the slot. The retaining spring may be configured to adjustably secure the slider in a particular position within the slot. Moreover, the first bar may additionally comprise a locking fastener configured to selectably secure the slider in a particular position within the slot. In certain embodiments, the location of the pivot point relative to the anchor point is infinitely adjustable between a first position corresponding to a first stitch length and a second position corresponding to a second stitch length, the second stitch length being shorter than the first stitch length.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

Figure 1:
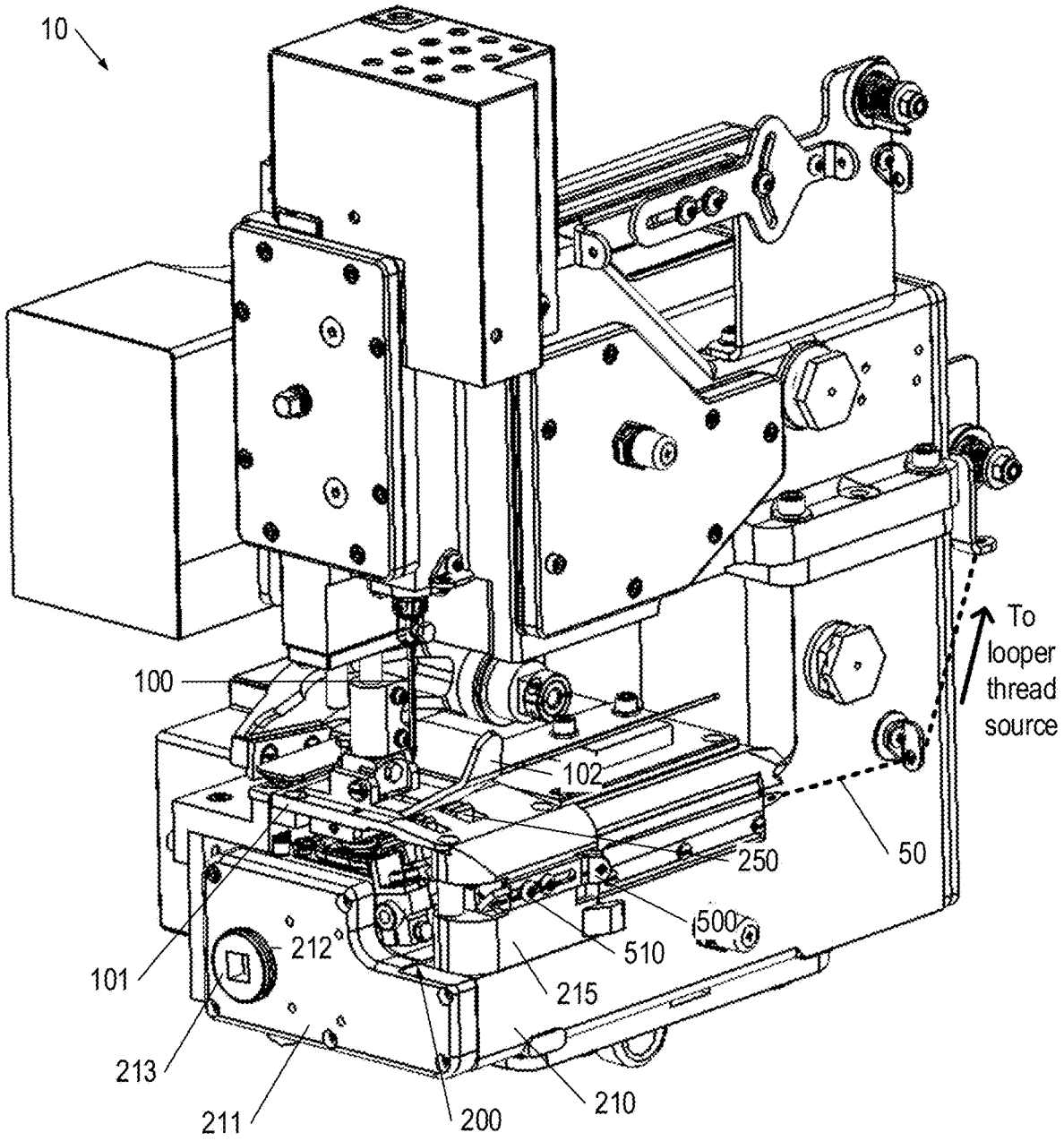
FIG. 1 is a perspective view of a sewing machine according to one embodiment.

FIG. 1 illustrates a 2-thread sewing machine 10 configured according to various embodiments. The sewing machine 10 creates a locking stitch at defined intervals along a sewing path that "locks" a top thread moved by a needle 100 with a bottom, looper thread, thereby entraining sewn material therebetween. In certain embodiments the sewing machine may be configured for sewing bag closures on fabric bags, paper bags, non-woven bags, woven-bags, and/or the like.

Figure 2:
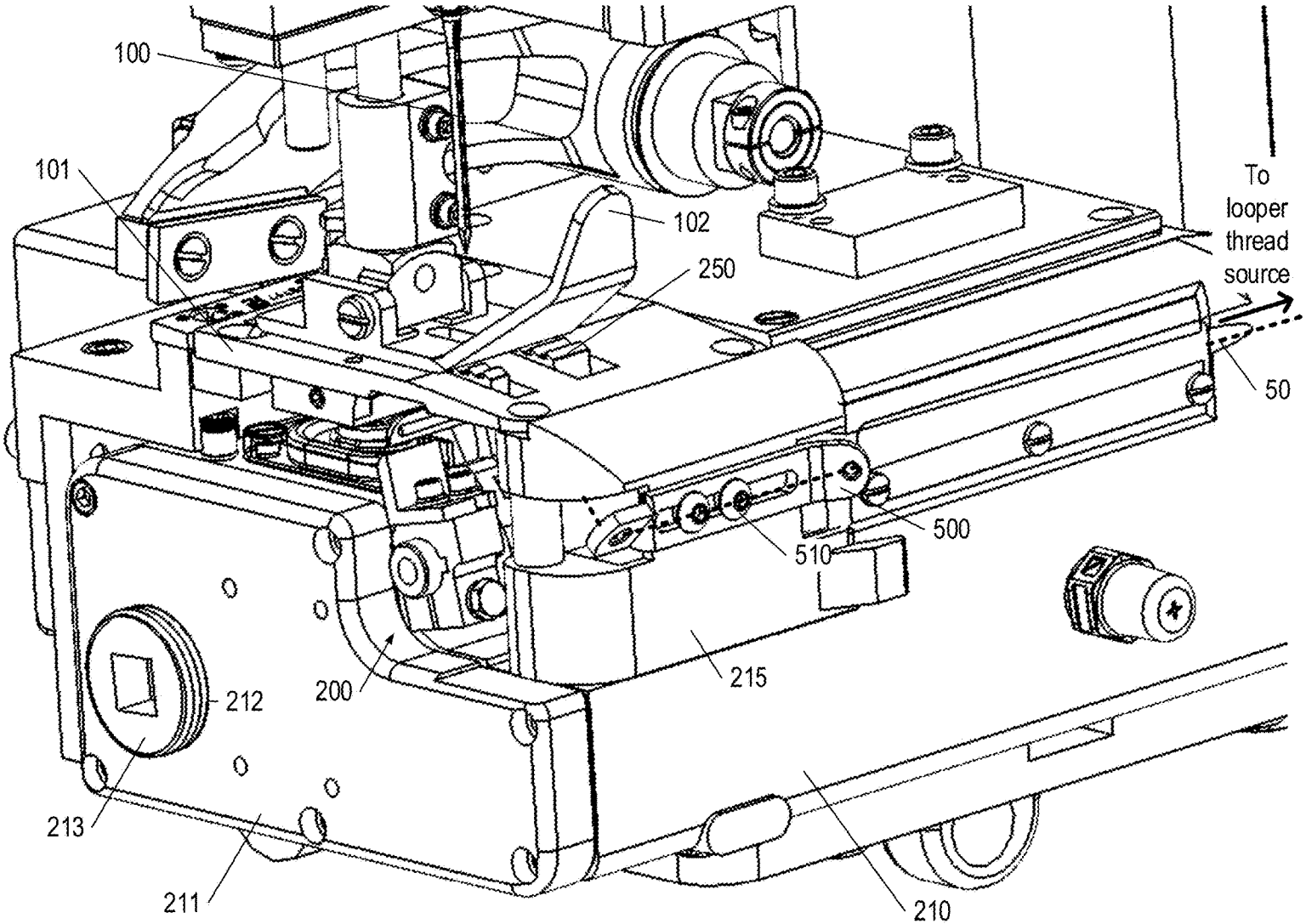
FIG. 2 is another perspective view of a portion of a sewing machine according to one embodiment.
Figure 3:
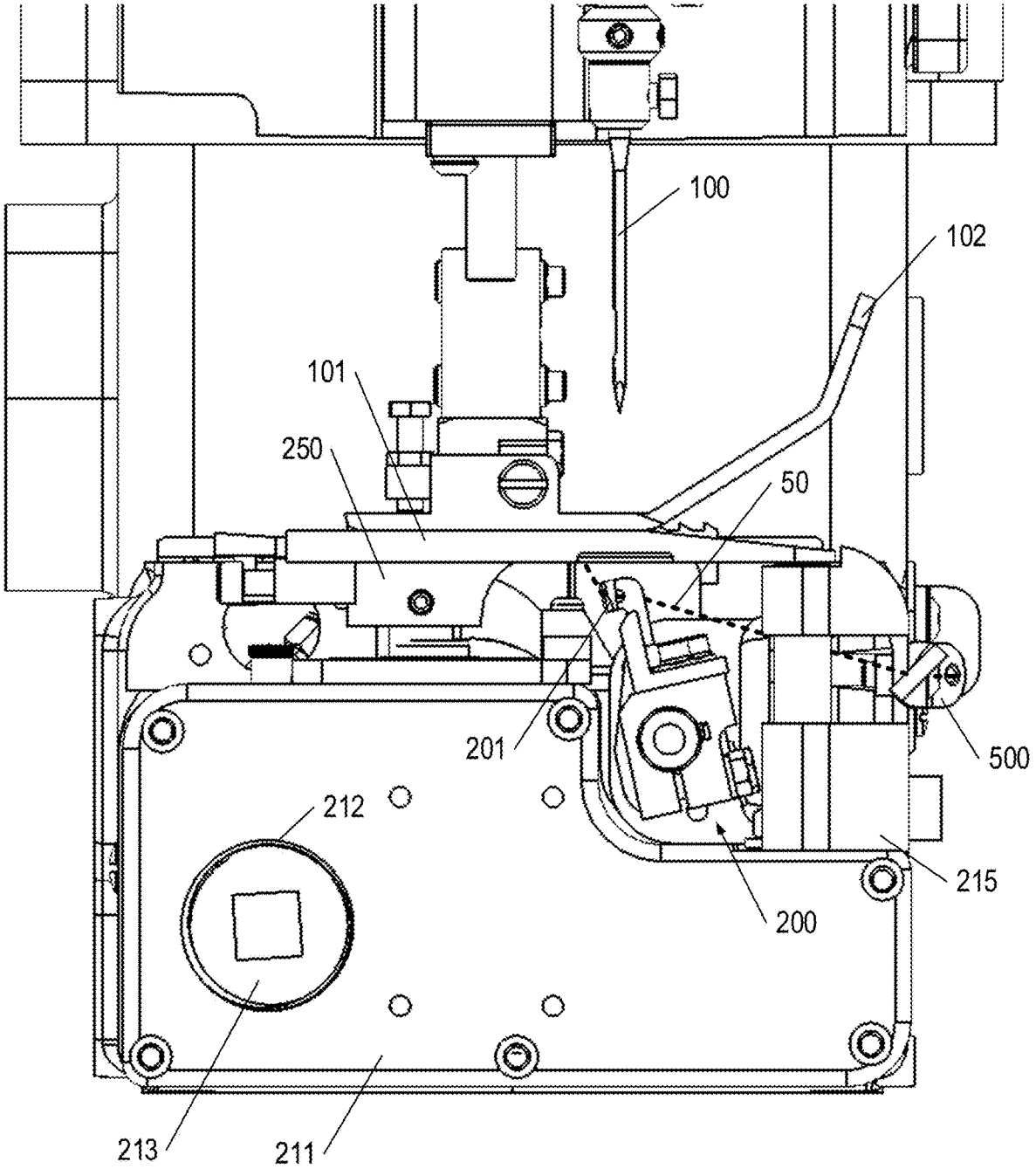
FIG. 3 is a side-view of a portion of a sewing machine according to one embodiment.
Figure 4:
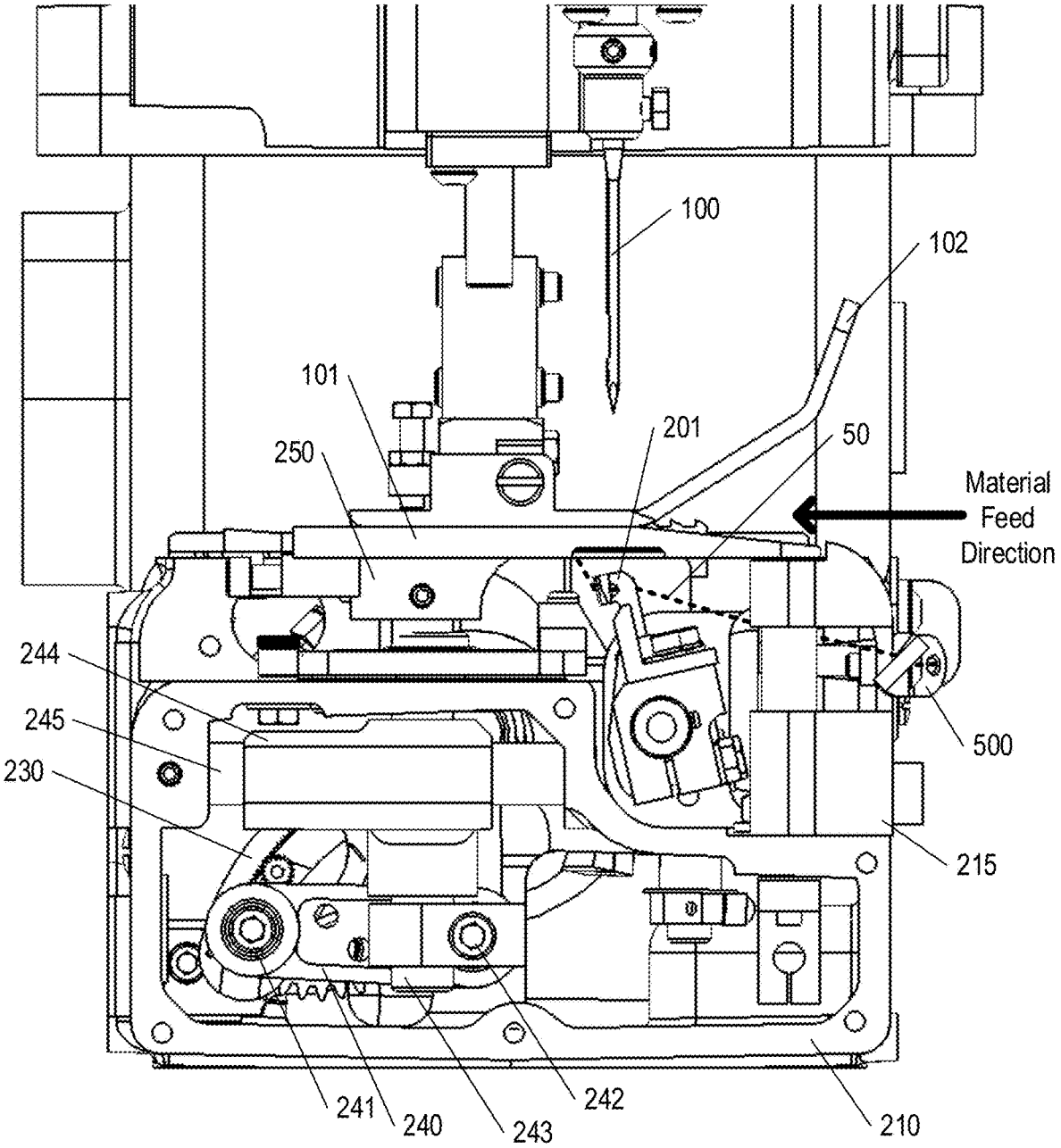
FIG. 4 is a side-view of a portion of a sewing machine with a housing cover removed according to one embodiment.
Figure 5:
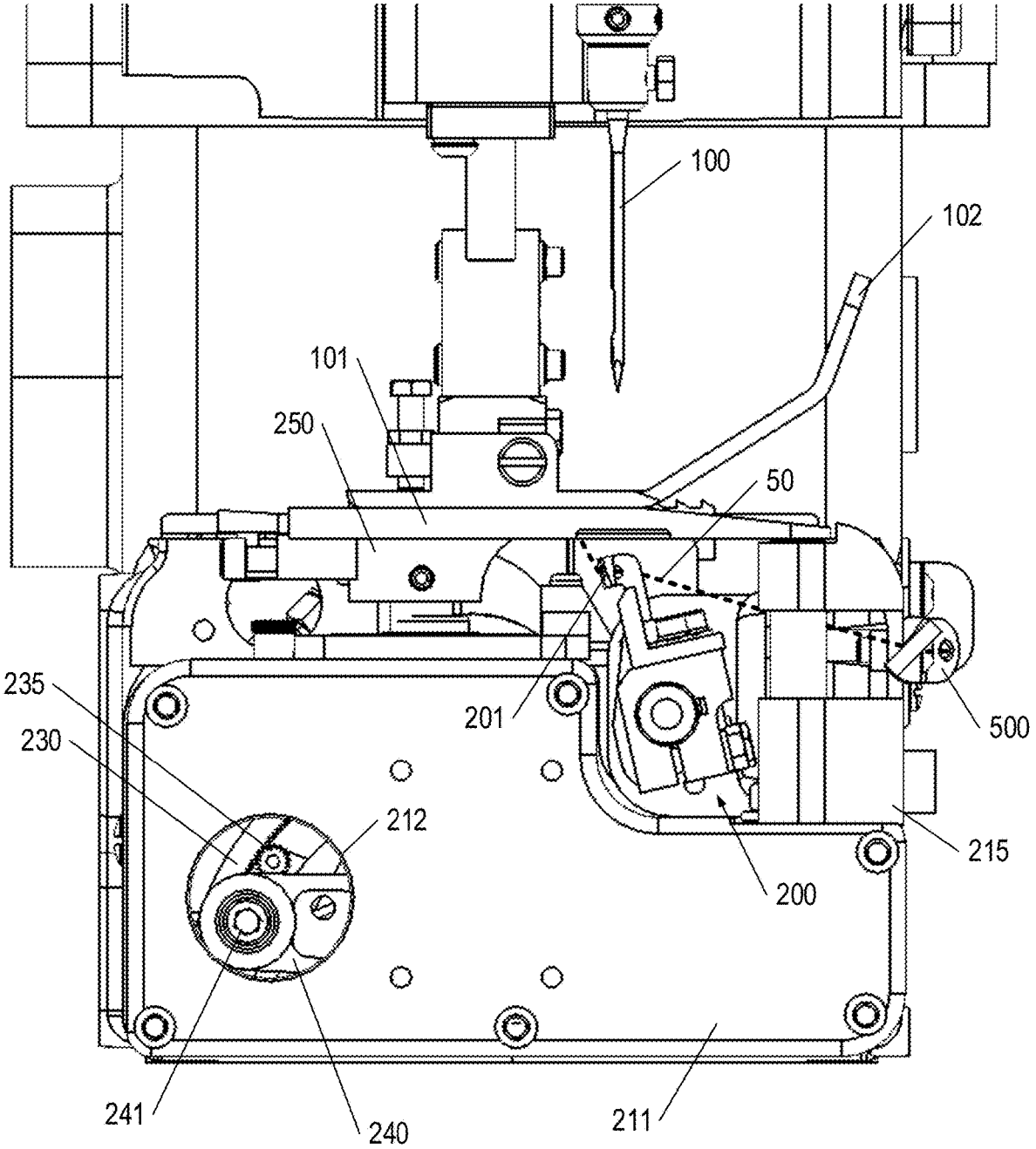
FIG. 5 is a side-view of a portion of a sewing machine with a housing port plug removed according to one embodiment.
Figure 6A:
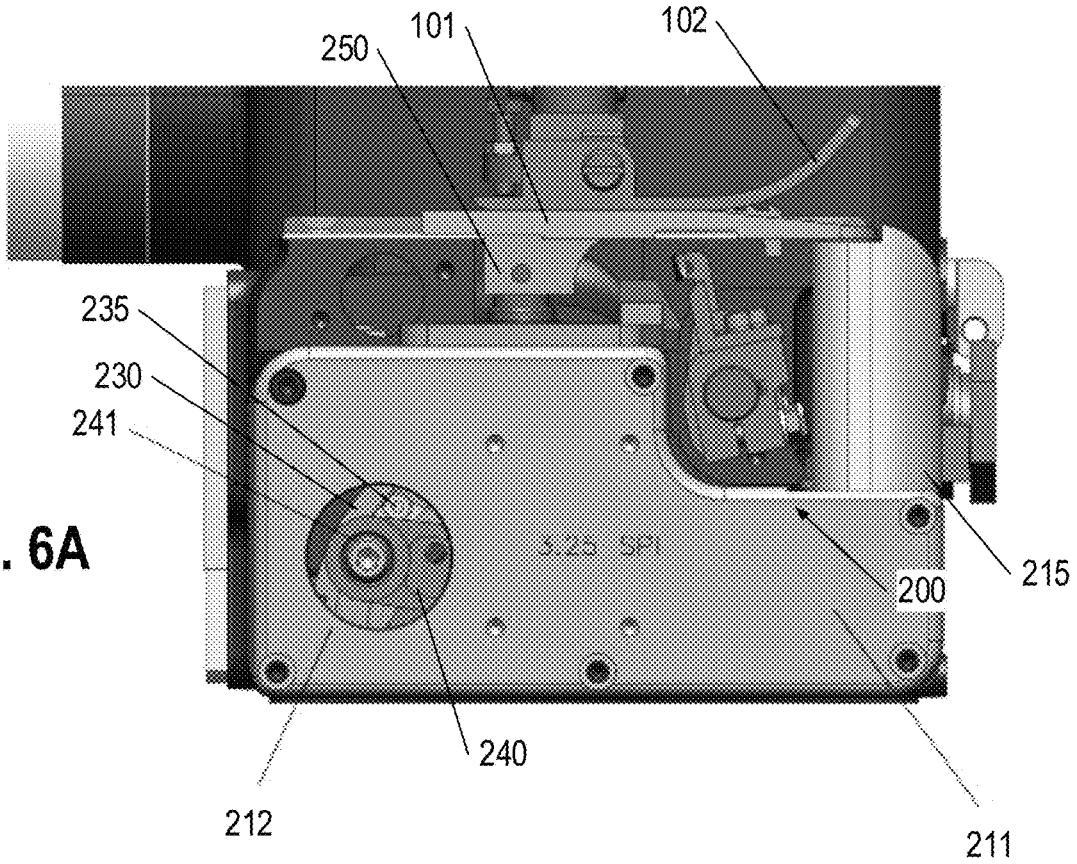
FIGS. 6A-6B are side-views of a portion of a sewing machine with a housing port plug removed, and a stitch length adjustment mechanism in various positions according to one embodiment.
Figure 6B:
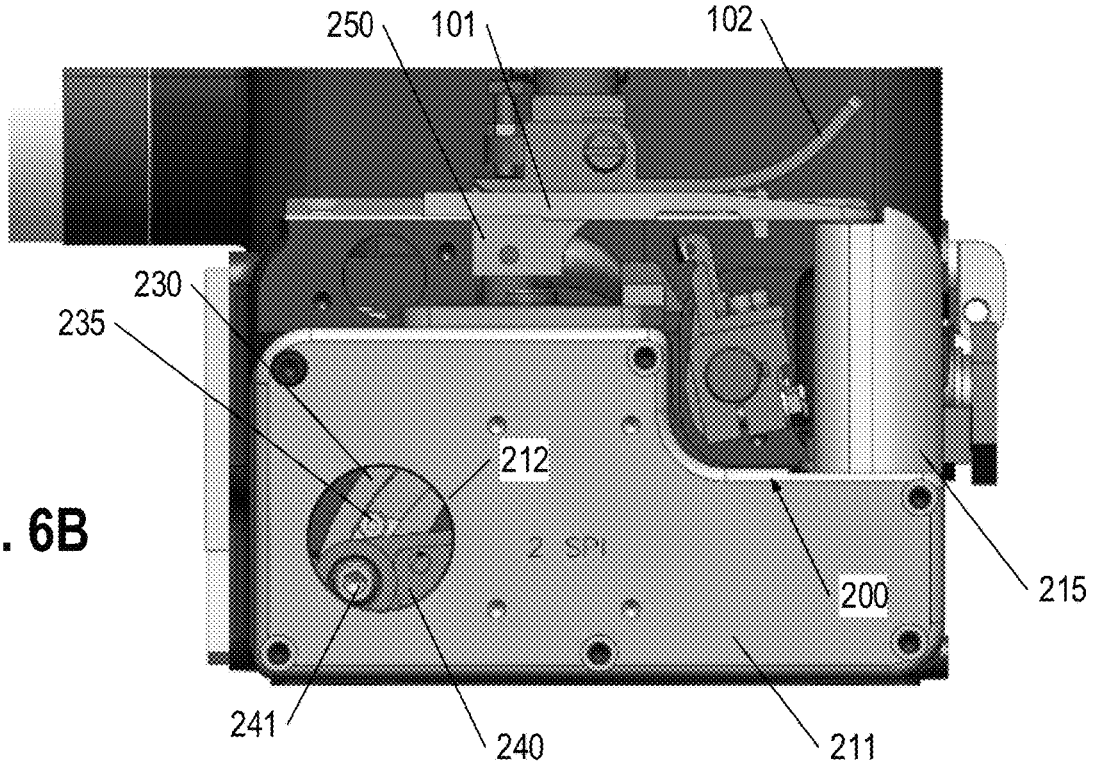

As shown in FIGS. 1-5, which show various views of a sewing machine 10 according to one embodiment, the sewing machine 10 defines a housing 210 within which various operating components are located. The sewing machine housing 210 may comprise at least one housing cover 211 that may be selectably removed (as shown in FIG. 4) to enable access to the interior of the housing 210. Moreover, as shown in FIGS. 5 and 6A-6B, the housing 210 may define a port 212 (e.g., extending through the housing cover 211) to enable selective access to a portion of the interior of the housing 210.

Stitch Formation and Stitch Length Adjustment

In operation, stitches are formed at discrete locations along a sewing path extending in a material feed direction that are spaced at substantially uniform intervals (the length of each interval corresponding to the lateral feed dog travel and the stitch length, as discussed herein). At each discrete location, a needle 100 located above a throat plate 101 moves vertically downward, through an aperture of a shoe 102 to punch a hole through the sewn material located on a top surface of the throat plate 101 and to pass through an aperture extending through the throat plate 101. The tip of the needle 100 defines a thread aperture extending laterally therethrough, and a needling thread passes through the thread aperture of the needle 100 (a first end of the needling thread is secured relative to a prior-formed stitch, and a second end of the needling thread is located at a needling thread supply). Thus, movement of the needle through the throat plate aperture pushes a needling thread loop through the hole created in the material, and through the aperture of the throat plate 101 such that it is available for manipulation below the throat plate 101 of the sewing machine 10.

The movement of the needle 100 (and needling thread) is coordinated with the movement of a looper mechanism 200 (and looper thread) shown in the side-view of FIG. 3 to create a locking stitch together with the needling thread and a feed dog 250 comprising a plurality of ridges on a top surface thereof, the plurality of ridges configured to engage the underside of the material resting on the throat plate 101 and to move the material in the material feed direction to advance to the next stitch location after formation of a locking stitch. While the needle 100 moves through the material, the feed dog 250 (described in greater detail below) moves below the throat plate 101 (such that the feed dog 250 is not in contact with the material on the top surface of the throat plate 101) in a direction opposite the material feed direction to reset the position of the feed dog 250 prior to advancing the material. The looper mechanism 200 reciprocates in a generally elliptical motion around the needle 100 to loop the looper thread around the needling thread to create the lock stitch. In certain embodiments, the needle 100 plunges through the material while the looper mechanism 200 is in a first position such that the needle 100 (and the needling thread) extends through a loop in the looper thread. The looper mechanism 200 may then extend, such that a distal end of a looper arm 201 extends between the needle 100 and the needle thread. The looper thread, which extends along a length of the looper arm 201 likewise extends through the needle thread. As the needle 100 retracts upward, the needle thread becomes caught on the looper arm 201 and the loop in the looper thread tightens around the needling thread. Once the needle 100 is located entirely above the material, the feed dog 250 (described in detail herein) moves the material in the material feed direction, thereby placing the looper thread under tension to tighten the loop further. The looper mechanism 200 then retracts, causing the needling thread to be released and tightened by the still-moving feed dog 250 to form the lock stitch. The process is then repeated once the material is moved to the subsequent stitch location.

As mentioned, the movement of the feed dog 250 is coordinated with the movement of the needle 100 and the looper 200. Once the needle 100 retracts above the top surface of the material, the feed dog 250 engages the bottom surface of the material (e.g., by extending at least partially above the top surface of the throat plate 101) and moves at least substantially laterally in the material feed direction to advance the material to the next stitch location. As the feed dog 250 moves the material, the loosely formed lock stitch on the bottom surface of the material is tightened by the movement of the material relative to the movement of the looper mechanism 250. This tightens the lock stitch to secure the lock stitch relative to the material prior to forming the next lock stitch at the subsequent stitch location, spaced a distance away from the previous lock stitch equal to the stitch length. The process of plunging the needle 100 through the material, and looping the looper thread around the needle thread is repeated while the feed dog 250 drops below the top surface of the throat plate 101 and moves back in the direction opposite the material feed direction prior to advancing the material again.

All of the components of the sewing machine 10 are driven by at least one motor providing rotational motion to at least one drive shaft 220 configured to provide rotational forces to various components of the sewing machine 10. In certain embodiments, the sewing machine 10 may comprise two drive shafts—an upper drive shaft configured to drive the vertical motion of the needle 100 (e.g., via a rotational-to-linear motion conversion mechanism, such as a mechanical linkage), and a lower drive shaft 220 configured to drive the motion of the looper mechanism 200 and feed dog 250 of the sewing machine. As shown at least at FIGS. 7A-7B, the drive shaft 220 may be configured to elliptically move an auxiliary shaft 221 extending parallel to the drive shaft 220. The auxiliary shaft 221 is secured relative to a multi-link feed dog 250 movement mechanism to provide 2 degrees of motion for the feed dog 250 (e.g., vertical motion and lateral motion parallel to the material travel direction) to enable the elliptical motion path of the feed dog 250 relative to the throat plate 101.

Figure 7A:
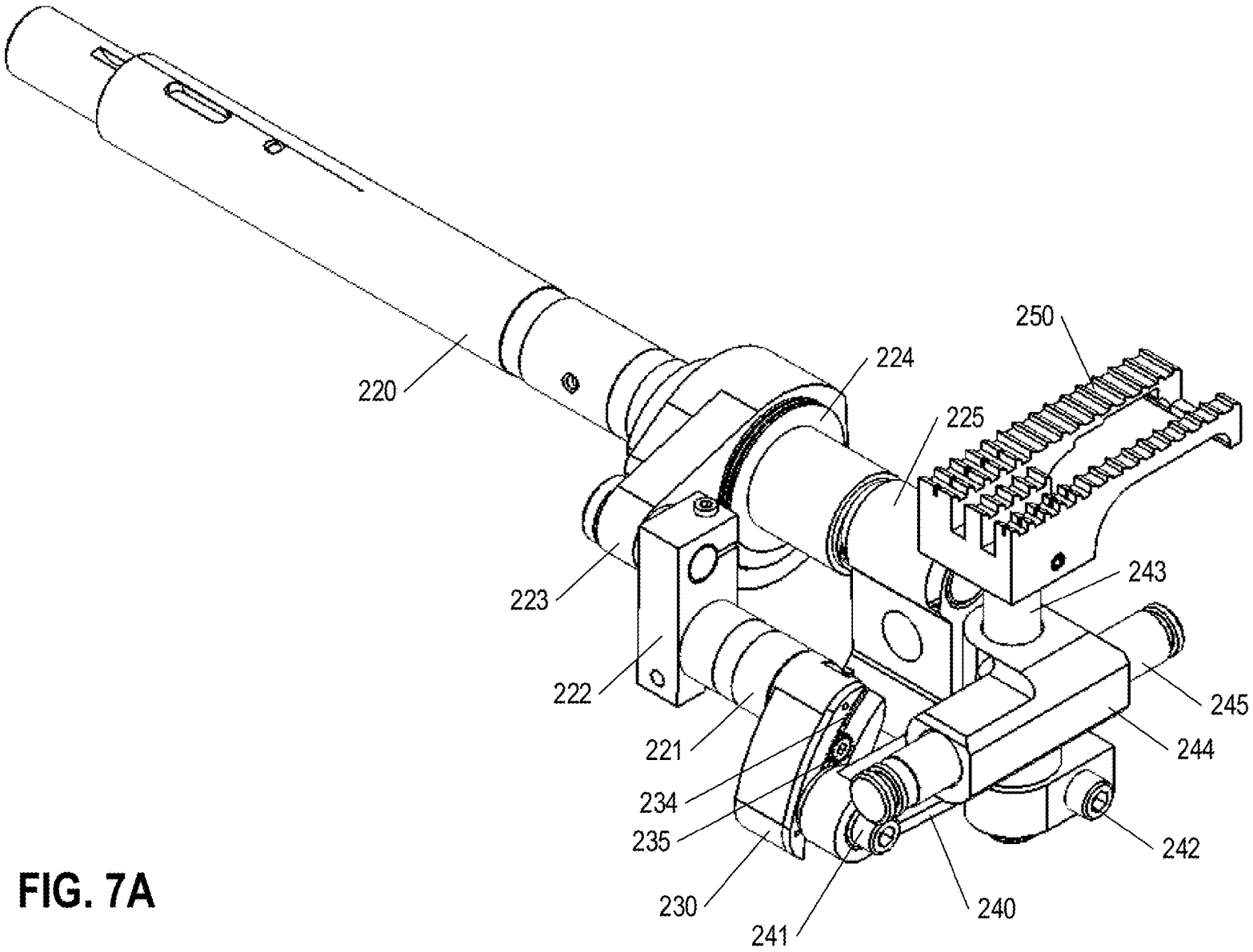
FIGS. 7A-7B are perspective views of a drive shaft secured relative to a stitch length adjustment mechanism according to one embodiment.
Figure 7B:
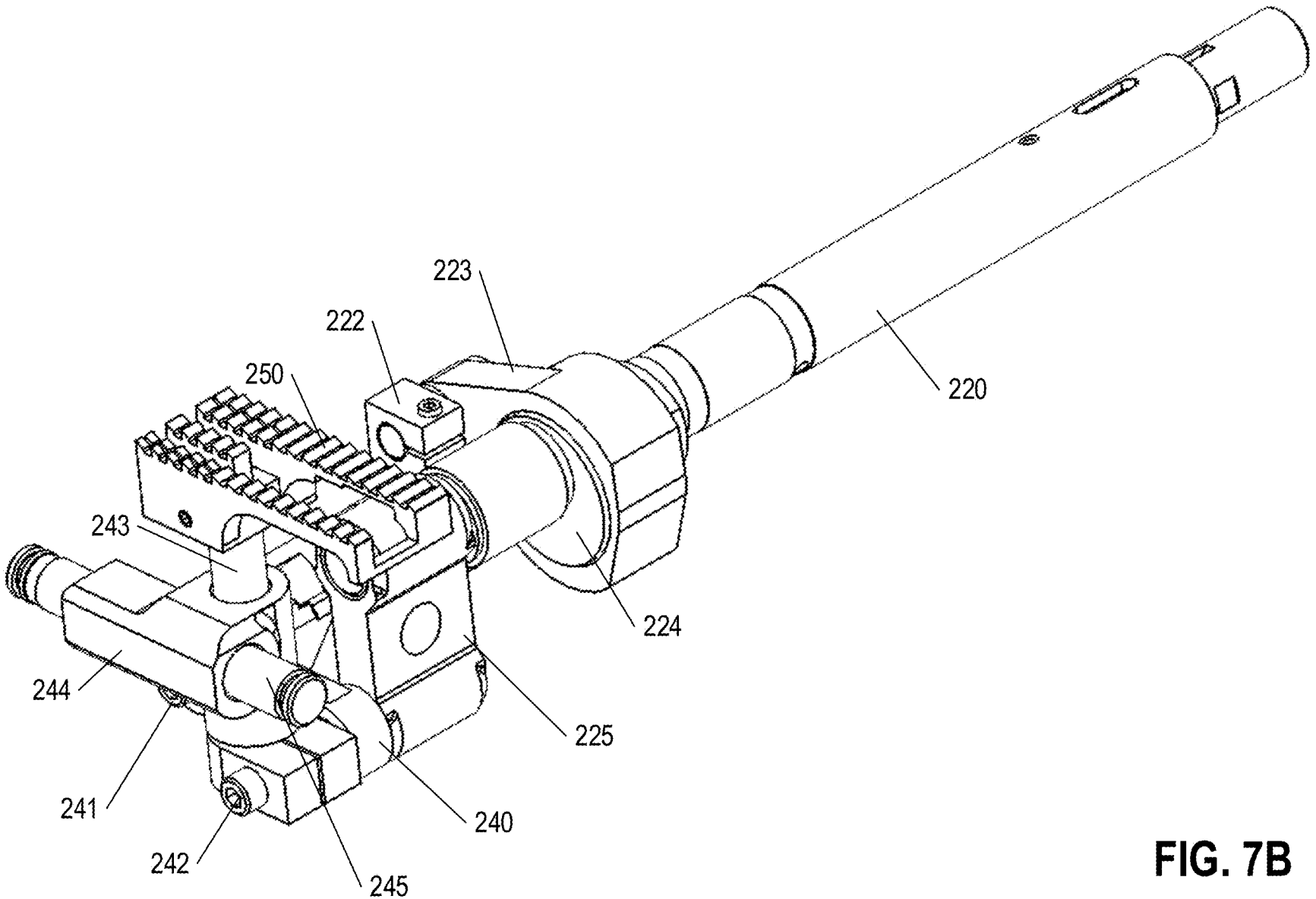

As shown in FIGS. 7A-7B, the auxiliary shaft 221 is secured relative to the drive shaft 220 via an offset 222 and a parallel coupler 223. In the illustrated embodiment, a driven end of the auxiliary shaft 221 is immovably secured relative to the offset 222 (e.g., via a friction fitting). Moreover, the parallel coupler defines parallel apertures comprising a first aperture through which a pin secured to the offset 222 is secured (e.g., immovably secured via a friction fitting) and a second aperture rotatably secured relative to an eccentric rotator 224 rotating with the drive shaft 220. The eccentric rotator 224 has a circular outer circumference, and has an eccentrically located through hole positioned therein, with the drive shaft 220 frictionally engaging the eccentrically located through hole to rotate the eccentric rotator 224 with the drive shaft. Thus, as the drive shaft rotates, the eccentric rotator 224 likewise rotates within the second aperture of the parallel coupler 223, which causes the parallel coupler 223 (and by consequence the auxiliary shaft 221) to move about a generally circular path offset from the drive shaft 220.

Figure 8:
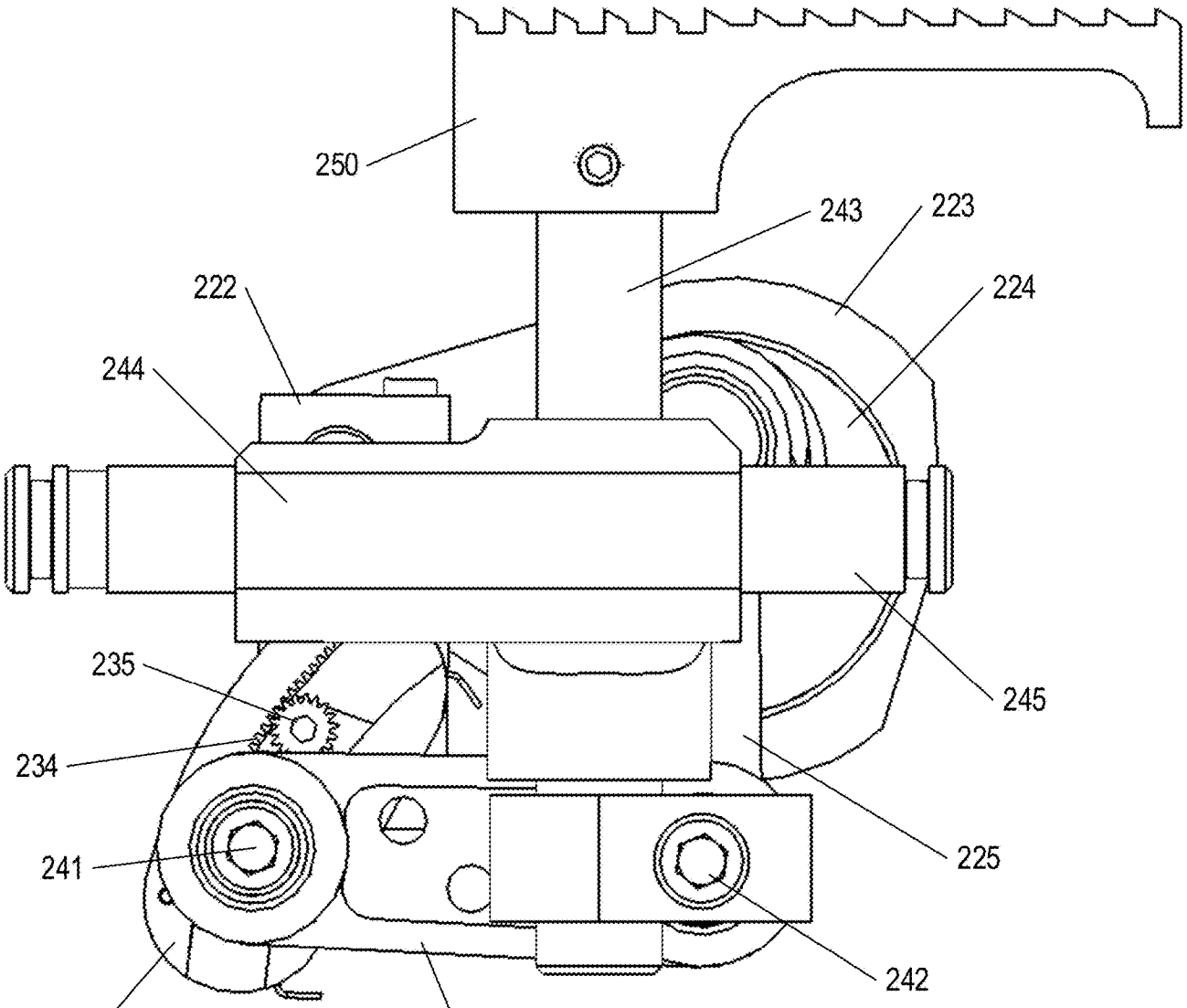
FIG. 8 is a side-view of a drive shaft secured relative to a stitch length adjustment mechanism according to one embedment.

A distal end opposite the driven end of the auxiliary shaft 221 is secured at an anchored end of a first bar 230 such that movement of the auxiliary shaft 221 causes movement of the first bar 230. As shown in FIGS. 7A-7B and FIG. 8 (which provides an end-on view of the feed dog movement mechanism), the first bar 230 is rotationally secured to a second bar 240 at a pin point 241. The pin point 241 is at least substantially linearly movable between the anchor end of the first bar 230 and a distal end of the first bar 230, such that the effective length of the first bar 230 (e.g., measured between an axis extending through the anchor point and an axis extending through the pin point 241) is variable as discussed in greater detail herein.

A distal end of the second bar 240 (opposite the pin point 241) is secured relative to a feed dog slider mechanism comprising a vertical slide rod 243 configured to slide relative to a feed dog slider 244, which is configured to slide (with the vertical slide rod 243) along a horizontal slide rod 245. Specifically, the distal end of the second bar 240 is rotatably secured to a lower end of the vertical slide rod 243 at pivot point 242. The vertical slide rod 243 is pinned at the lower end relative to the distal end of the second bar 240 and relative to a swing arm 225 extending at least substantially perpendicular to a drive shaft axis and a pivot point 242 axis between a distal end of the drive shaft 220 and the pivot point 242. The upper end of the vertical slide bar 243 is pinned to the feed dog 250. The vertical slide rod 243 is configured to slide vertically within the feed dog slider 244 which is configured for lateral movement relative to the horizontal slide rod 245 that is secured relative to the sewing machine housing 210. Thus, the vertical slide rod 243 is configured to move vertically within the feed dog slider 244, and is configured to move horizontally with the feed dog slider 244 along the stationary horizontal slide rod 245.

In use, the auxiliary shaft 221 moves, thereby moving the first bar 230 of the multi-bar linkage, which moves the second bar 240 of the multi-bar linkage. The second bar 240 of the multi-bar linkage applies vertical forces to the lower end of the vertical slide bar 243 (which causes the vertical slide bar 243 to move vertically within the feed dog slider 244 to move the feed dog 250 vertically) and horizontal forces to the vertical slide bar 243 (which causes the vertical slide bar 243 and the feed dog slider 244 to move horizontally along the horizontal slide bar 245, thereby moving the feed dog 250 horizontally). As the auxiliary shaft 221 moves, the multi-bar linkage causes the feed dog 250 to move at least substantially elliptically (including the vertical and horizontal movement components discussed above) to move the sewn material in the material feed direction. The feed dog 250 moves (1) in a direction substantially opposite the material feed direction while an upper surface of the feed dog 250 is below the top surface of the throat plate 101, (2) upwards to engage a bottom surface of the material and to breach the upper surface of the throat plate 101, (3) in the material feed direction while the feed dog 250 is located at least partially above the throat plate 101, and (4) downward such that the upper surface of the feed dog 250 moves below the upper surface of the throat plate 101, before repeating the at least substantially elliptical motion path.

Figure 9:
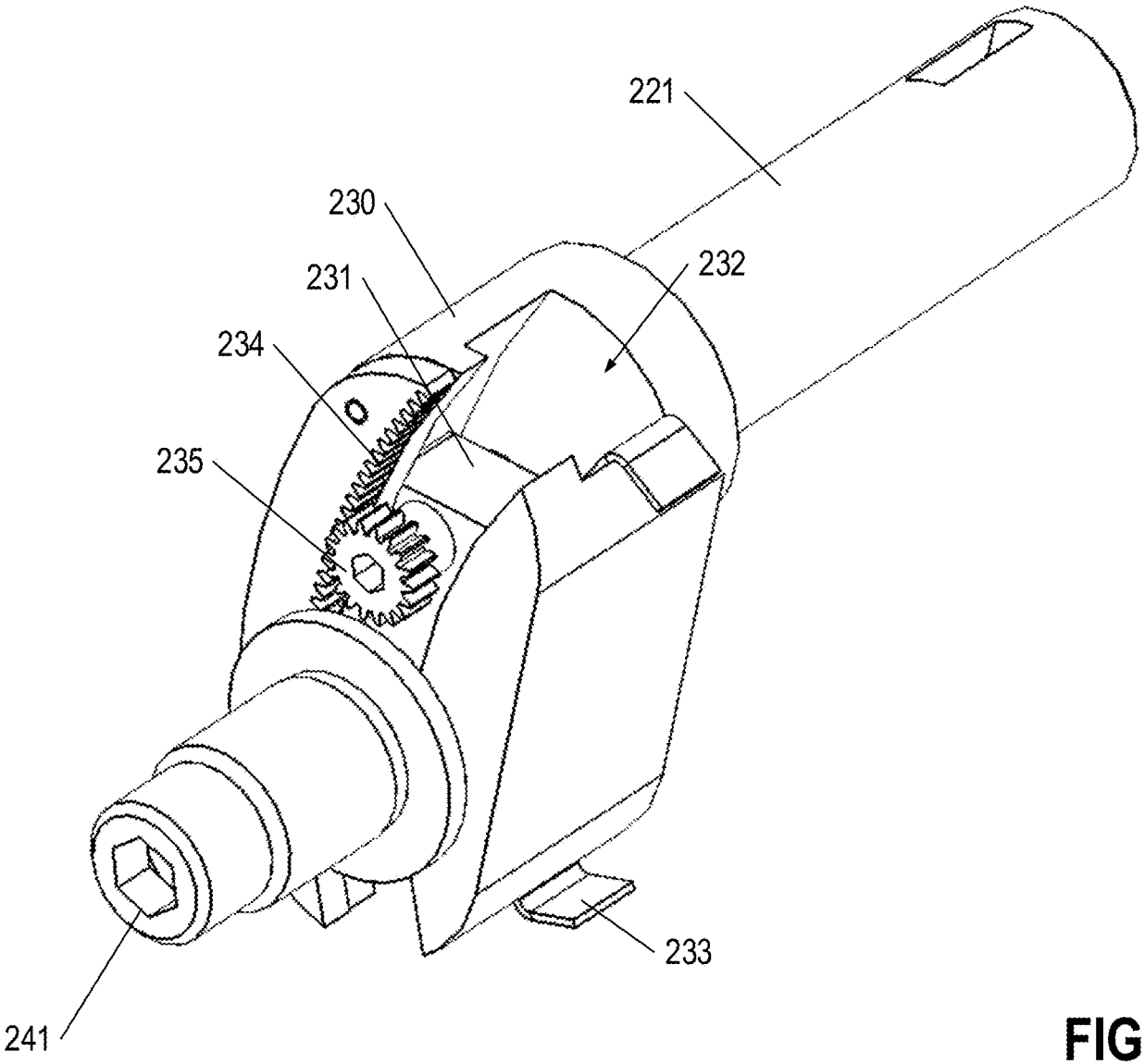
FIG. 9 is a perspective view of a stitch length adjustment mechanism shown in isolation according to one embodiment.

As mentioned herein, the feed dog travel path is adjustable to vary the stitch length of the sewing machine 10. In certain embodiments, the stitch length may vary between about 2 stitches per inch to about 3.5 stitches per inch. FIG. 9 illustrates an isolated perspective view of a stitch length adjustment mechanism embodied as a portion of the first bar 230 according to one embodiment. As shown in FIG. 9, the feed dog travel path adjustment mechanism is embodied as a mechanism configured to adjust the effective length of the first bar 230 of the multi-bar linkage discussed above. The adjustment mechanism enables movement of the pin point 241 of the first bar relative to the anchor point of the first bar 230. Specifically, the pin point 241 of the first bar 230 is slidable along at least a portion of the length of the first bar 230.

Figure 10:
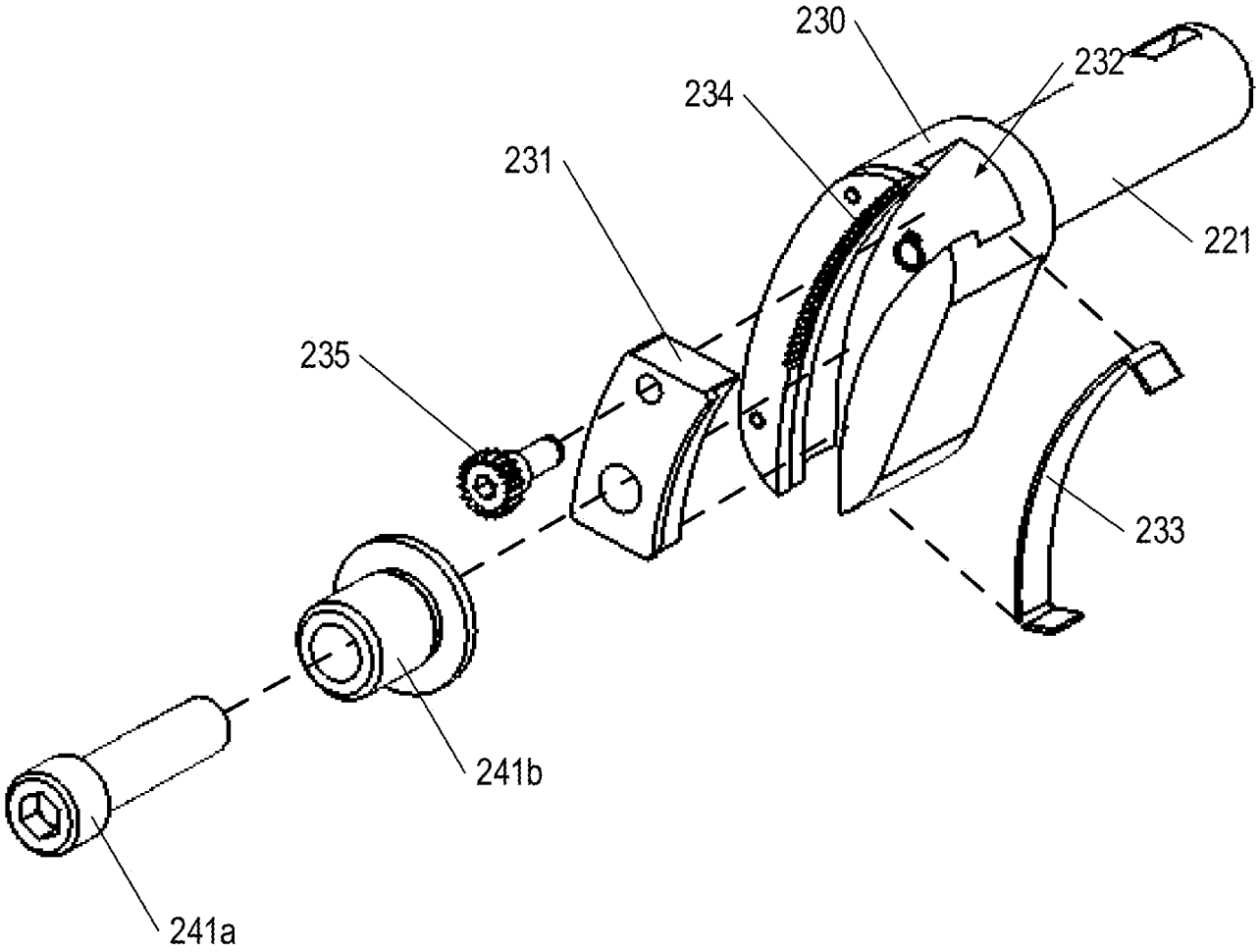
FIG. 10 is an exploded view of a stitch length adjustment mechanism according to one embodiment.

The pin point 241 is secured relative to a slider 231 configured to slide within a corresponding slot 232 of the first bar 230. In the illustrated embodiment, the slider 231 has a shape corresponding to the shape of the slot 232 to enable the slider 231 to slide easily relative to the slot 232. For example, the slider 231 may have a generally arcing shape configured to correspond to the arcing shape of the slot 232. As yet another example, the slider 231 may have a generally rectangular shape configured to correspond to a generally linear shape of the slot 232. Moreover, as shown in FIGS. 9-10 (FIG. 10 being an exploded view of the stitch length adjustment mechanism), the slot 232 may have a generally "T"-shaped cross-section having a wide portion and a narrow open portion extending between a front surface of the first bar 230 and the wide portion. The slider 231 may be sized to fit within the wide portion of the slot 232, such that the slider 231 cannot fit through the narrow portion of the slot 232 (where the pin point 241 and pinion 235 are located).

As shown in FIG. 9, the slider 231 is biased against a side wall of the slot 232 by a retaining spring 233. The retaining spring 233 presses the slider 231 against the side wall of the slot 232 to frictionally engage the slider 231 relative to the sidewall of the slot 232, such that static frictional forces between the slider 231 and the sidewall of the slot 232 prevent the slider 231 (and the pin point 241) from undesirably moving relative to the first bar 230. The retaining spring may be a leaf spring secured relative to a second side-wall of the slot 232 and configured to provide a compressive force against the slider 231 to push the slider 231 against the opposite first side-wall of the slot 232. Moreover, as shown in the exploded view of FIG. 10, the slider 231 may have a recessed side portion configured to engage the retaining spring 233 such that the overall width of the slider 231 is greater than the width of the narrow portion of the slot 232.

A first side of the slot shown in FIGS. 9-10 defines a gear rack 234 configured to engage a pinion 235 rotatably secured relative to the slider 231. As shown in FIGS. 9-10, the gear rack 234 may be disposed on a separate component (comprising a material different from the materials of the first bar 230 and/or slider 231) secured relative to the first bar 230 (e.g., via one or more fasteners), although in various embodiments the gear rack 234 is integrally formed with the first bar 230. The pinion 235 defines a centrally-located tool engagement feature (e.g., an Allen-wrench slot, a flat-head screwdriver slot, a Phillips-head screwdriver slot, a Torx-head screwdriver slot, and/or the like). The pinion 235 is rotatable (e.g., via a separate tool) relative to the gear rack 234, thereby moving the slider 231 within the slot 232 of the first bar 230. Thus, the effective length of the first bar 230 is adjustable by rotating the pinion 235 relative to the gear rack 234, thereby moving the slider 231 toward or away from the anchor point of the first bar 230. Once a particular effective length of the first bar 230 is selected, the retaining spring 233 impedes unintentional movement of the slider 231 by providing a static frictional force between the slider 231 and the sidewall of the slot 232.

Figure 11:
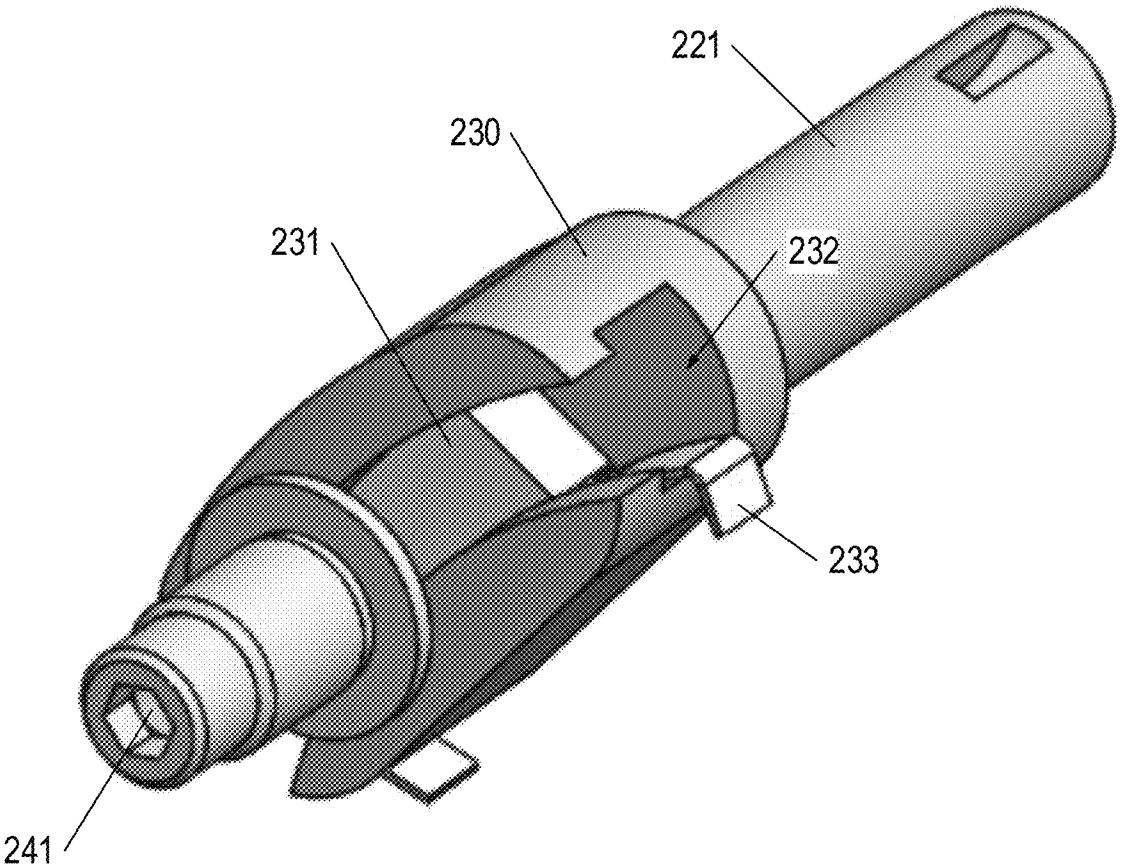
FIG. 11 is a perspective view of a stitch length adjustment mechanism according to one embodiment.
Figure 12:
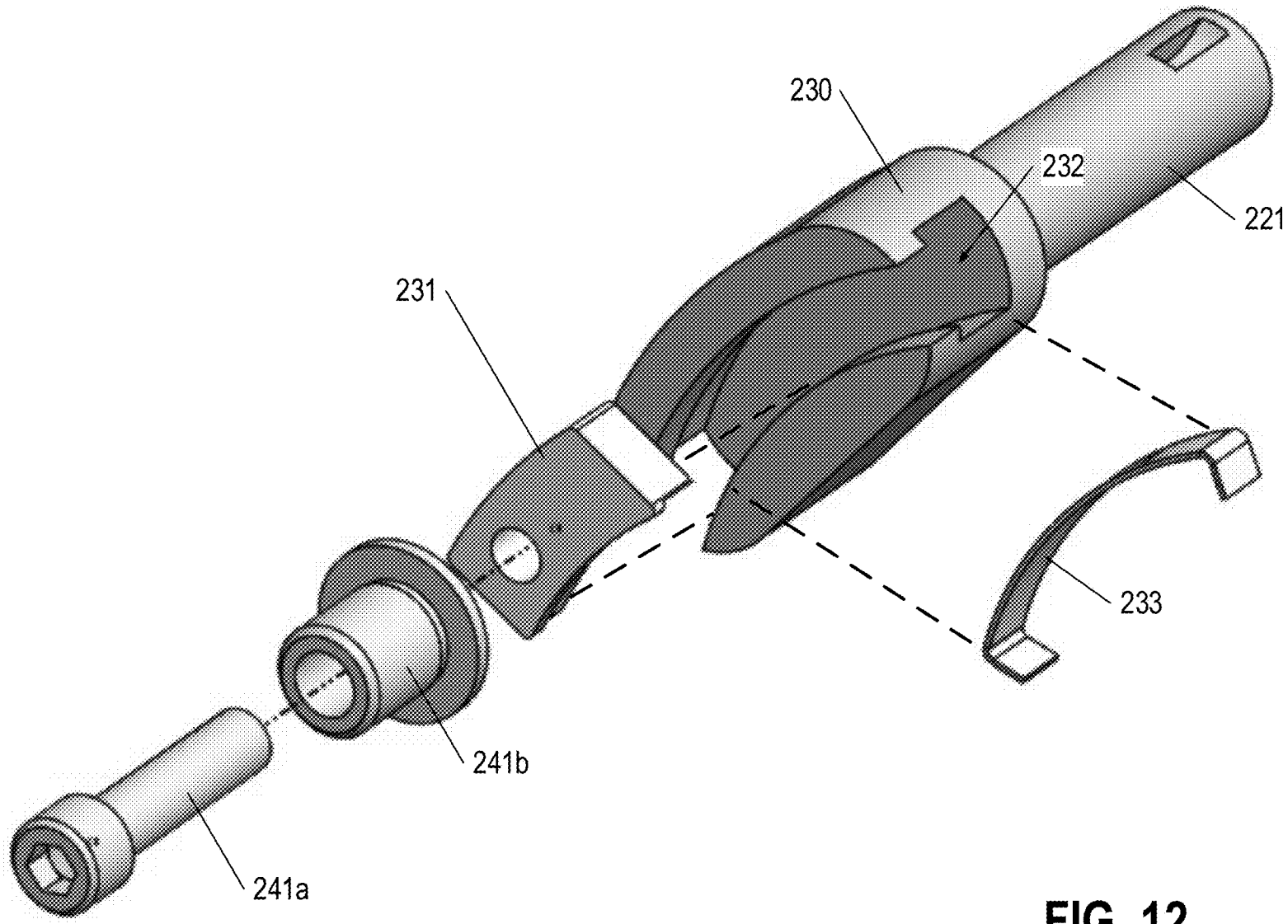
FIG. 12 is an exploded view of a stitch length adjustment mechanism according to one embodiment.

FIGS. 11-12 illustrate another embodiment of a stitch length adjustment mechanism of a first bar 230 for adjusting the feed dog travel path. Like the embodiment shown in FIGS. 9-10, the stitch length adjustment mechanism is configured to adjust the effective length of the first bar 230 of the multi-bar linkage discussed herein. The adjustment mechanism shown in FIGS. 11-12 enables movement of the pin point 241 of the first bar relative to the anchor point of the first bar 230 by sliding the pin point 241 of the first bar 230 along at least a portion of the length of the first bar 230.

As shown in FIG. 11, the pin point 241 is secured relative to a slider 231 configured to slide within a corresponding slot 232 of the first bar 230. In the illustrated embodiment, the slider 231 has a shape corresponding to the shape of the slot 232 to enable the slider 231 to slide easily relative to the slot 232. In the embodiment shown in FIGS. 11-12, the slider 231 and slot 232 have corresponding shapes, such as those discussed in reference to FIGS. 9-10, above.

In the embodiment of FIG. 11, the slider 231 is biased against a side wall of the slot 232 by a retaining spring 233. The retaining spring 233 presses the slider 231 against the side wall of the slot 232 to frictionally engage the slider 231 relative to the sidewall of the slot 232, such that static frictional forces between the slider 231 and the sidewall of the slot 232 prevent the slider 231 (and the pin point 241) from undesirably moving relative to the first bar 230. The retaining spring may be a leaf spring secured relative to a second side-wall of the slot 232 and configured to provide a compressive force against the slider 231 to push the slider 231 against the opposite first side-wall of the slot 232. As shown in FIG. 12, the slider 231 may have a recessed side portion configured to engage the retaining spring 233 such that the overall width of the slider 231 is greater than the width of the narrow portion of the slot 232.

Adjustment of the effective length of the first bar 230 according to the embodiment of FIG. 11 may be performed by subjecting the slider 231 to a force sufficient to overcome the frictional holding forces imparted on the slider 231 by the retaining spring 233 to slide the slider 231 within the slot 232 (toward or away from the anchor point of the first bar 230) to a desired position within the slot 232. Once a particular effective length of the first bar 230 is selected, the retaining spring 233 impedes unintentional movement of the slider 231 by providing a static frictional force between the slider 231 and the sidewall of the slot 232.

The slider may additionally comprise a locking fastener (e.g., screw) secured at the pin point 241 that may be engaged once a desired effective length of the first bar 230 is selected. As shown in FIG. 10, the pin point 241 may be defined by a locking fastener 241*a* secured relative to the slider 231 (e.g., non-rotatably secured) and having a rotatable bearing 241*b* secured thereto. For example, the locking screw shown in FIG. 10 may be tightened to provide a holding force between the slider 231 and the first bar 230. In certain embodiments, the locking fastener extends through the slider 231 to engage a bottom surface of the slot 232. In certain embodiments, the locking fastener is secured relative to the slider 231, such that engaging the bottom surface of the slot 232 presses the slider 231 against a top surface of the slot 232 (e.g., defined by ridges separating the wide portion from the narrow portion of the slot 232). The locking fastener may be engaged while the sewing machine 10 is in use, to ensure that mechanical forces applied to the first bar 230 do not change the effective length of the first bar 230 during use of the sewing machine 10.

Thus, to change the effective length of the first bar 230 (and therefore to change the stitch length of the sewing machine 10), a user first loosens the locking fastener to enable movement of the slider 231 relative to the slot 232 in the first bar 230. The locking fastener may be loosened via a corresponding tool configured to engage a tool engagement feature of the locking fastener.

Once the locking fastener is loosened, the user may engage a tool with the pinion 235 of the slider 231, and may turn the pinion 235 relative to the slider slot's gear rack 234 to move the pinion 235 (and the slider 231) toward or away from the anchor point of the first bar 230. Moving the slider 231 away from the anchor point increases the effective length of the first bar 230 by moving the pin point 241 between the first bar 230 and second bar 240 away from the anchor point of the first bar 230. This therefore enables a longer horizontal motion path of the vertical slide bar 243, which provides a longer stitch length of the sewing machine 10. Moving the slider 231 toward the anchor point decreases the effective length of the first bar 230 by moving the pin point 241 between the first bar 230 and second bar 240 toward the anchor point of the first bar 230. This therefore enables a shorter horizontal motion path of the vertical slide bar 243, which provides a shorter stitch length of the sewing machine 10.

As shown in FIGS. 5 and 6A-6B, the locking fastener and/or the pinion 245 may be accessible to a user desiring to adjust the stitch length of the sewing machine 10 via an access port 212 extending through at least a portion of the sewing machine housing 210 (e.g., through a housing cover 211). In certain embodiments, the access port 212 may comprise a corresponding port plug 213 configured to engage at least a portion of the sewing machine body 210 surrounding the access port 212 to selectably block access to the interior of the sewing machine housing 210 through the access port 212. In the example illustrated in FIG. 5, the access port 212 is surrounded by threaded sidewalls of the access port 212, and the port plug 213 defines an exterior surface having corresponding threads configured to engage the threaded sidewalls of the access port 212. FIGS. 6A-6B illustrate the pin point 241 located at a first position corresponding to a lengthened stitch length and a second position corresponding to a shortened stitch length, respectively, according to various embodiments. In certain embodiments, the pin point 241 may be infinitely adjustable between a first pin point 241 location corresponding to a shortened stitch length and a second pin point 241 location corresponding to a lengthened stitch length.

Looper Thread Tension Adjustment

As mentioned, adjusting the stitch length of the sewing machine 10 modifies the amount of tension applied to the looper thread below the throat plate 101. Increasing the stitch length (e.g., by increasing the distance the material is moved by the feed dog 250 between stitches) increases the amount of tension applied to the looper thread because the looper thread is directly connected to the previously formed stitch, which is moved away from the looper as the material is advanced by the feed dog 250. Likewise, decreasing the stitch length causes a corresponding decrease in the amount of tension applied to the looper thread while the material is moved by the feed dog 250.

Although small changes in the amount of tension on the looper thread are unlikely to change the functionality and/or effectiveness of the looper mechanism 200 as it reciprocates around the needle path to loop the looper thread around the needling thread and to tie a locking stitch with the looper thread and the needling thread, large changes in looper thread tension may cause the sewing machine 10 to miss stitches, to bunch the material on the throat plate 101, and/or to break the looper thread as the material is advanced. For example, a large increase in stitch length may cause the tension in the looper thread to apply a strong tensile force on the material being moved, such that the material is caused to bunch on the throat plate 101. The tensile force is applied to the material at the location of a previously formed stitch, and the feed dog 250 may be configured to push material behind the previously formed stitch in the material feed direction. The tension formed on the previous stitch by the looper thread may be sufficient to hold the material at its current location, while additional material is pushed against the prior stitch, thereby bunching the material between adjacent stitches. Alternatively, increasing the tension on the looper thread may be sufficient to overcome the tensile strength of the looper thread, thereby causing the looper thread to snap as the material is advanced.

On the other hand, decreasing the tension in the looper thread by decreasing the stitch length may create undesirable slack in the looper thread (e.g., between the looper mechanism 201 and the looper thread feed mechanism, and/or between the looper mechanism 201 and the previously formed stitch). The reciprocal movement of the looper mechanism 201 may cause the looper thread with the additional slack to sway or whip, which may position the looper thread in an undesirable position relative to the needle path as the needle 100 plunges through the material and the throat plate. The improper positioning of the looper thread prevents the formation of a proper locking stitch between the looper thread and the needling thread, thereby causing the sewing machine to miss a stitch.

Figure 13:
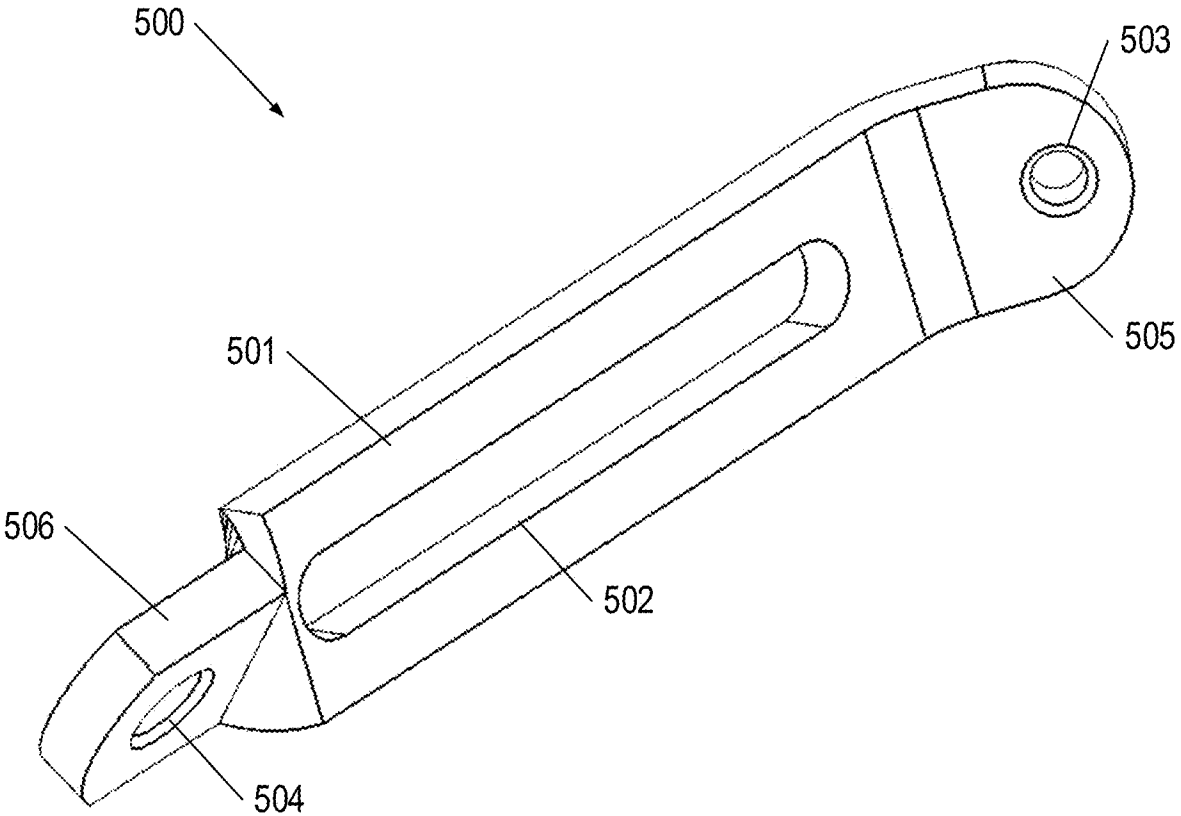
FIG. 13 is an isolated perspective view of an adjustable looper thread take-up eyelet according to one embodiment.

The illustrated embodiment comprises an adjustable looper thread take-up eyelet 500 configured to adjust the looper thread path length of the looper thread at a position proximate the looper mechanism 200. As shown in FIG. 13, the adjustable eyelet 500 comprises an at least substantially planar medial portion 501 defining a face surface and having an at least substantially linear adjustment slot 502 defined therein and extending through the adjustable eyelet 500 perpendicular to the plane of the face surface. As shown in FIG. 13, the adjustable eyelet 500 defines a base guide hole 503 proximate a base end of the adjustable eyelet 500 and a distal guide hole 504 proximate a distal end of the adjustable eyelet 500. As discussed herein, the looper thread path 50 extends at least substantially linearly between the base guide hole 503 and the distal guide hole 504 along the looper thread path 50 before extending along an at least substantially linear thread path portion to the looper mechanism 200. As shown in FIGS. 1-2, the looper thread path 50 extends along a first portion at least substantially parallel to the planar medial portion 501 of the adjustable eyelet 500, and accordingly the adjustable eyelet 500 may have an angled base portion 506 angled relative to the face surface and having the base guide hole 503 extend therethrough and an angled or skewed distal end portion 506 having the distal guide hole 504 extending therethrough. The angled base portion 505 may be angled relative to the face surface of the planar medial portion 501 such that the looper thread path 50 extends at least substantially linearly through the base guide hole 503 in a direction at least substantially parallel with a length of an elongated side of the planar medial portion 501. Moreover, the skewed distal end portion 506 may be configured to redirect the looper thread from a first direction extending parallel with the planar medial portion 501 of the adjustable eyelet 500 to a second direction extending into the sewing machine 10 to the looper mechanism 200. As shown in FIG. 13, the skewed distal end portion 506 may be skewed (e.g., rotated) about an axis parallel to the elongated length of the planar medial portion 501, such that a surface of the skewed distal end portion 506 is skewed relative to the face surface of the planar medial portion 501.

As shown therein, the looper thread path 50 extends from a previously formed stitch, through an aperture in the distal end of the looper arm 201, along the length of the looper arm 201 and through a second hole located at the base of the looper arm 201, before extending along an at least substantially linear portion of the looper thread path 50 to the distal guide hole 504 of the adjustable looper thread take-up eyelet 500 discussed above. The looper thread path 50 turns at the distal guide hole 504 and extends along another at least substantially linear portion from the distal guide hole 504 along the length of the adjustable eyelet 500 to the base guide hole 503 before extending across the base of the sewing machine to the looper thread source.

As shown in FIGS. 1-2, the adjustable eyelet is secured relative to an exterior surface of the sewing machine housing 210 at a location below the throat plate 101 (e.g., on a looper door 215 configured to selectably enable access to the looper mechanism 200). The adjustable eyelet 500 may be secured via at least one fastener 510 (e.g., two fasteners) extending through the adjustment slot 502 and secured relative to corresponding fastener securing points on the exterior surface of the sewing machine housing 210. In the example embodiment shown in FIGS. 1-2, the adjustable eyelet is secured relative to the sewing machine housing 210 via two fasteners 510 (e.g., two screws) secured to corresponding fastener securing points (e.g., apertures) through the adjustment slot 502. Utilizing two fasteners as shown in the attached illustration prevents undesirable rotation of the adjustable eyelet 500 relative to the sewing machine housing 210.

The adjustable eyelet 500 is adjustable between an extended position and a retracted position. In the extended position, the adjustable eyelet extends beyond a portion of the sewing machine housing 210 by a first distance, and one of the one or more fasteners 510 is adjacent a first end of the adjustment slot 502 proximate the base portion 505 of the adjustable eyelet 500. In the retracted position, the adjustable eyelet 500 extends beyond a portion of the sewing machine housing 210 by a second distance that is less than the first distance, and one of the one or more fasteners 510 is adjacent a second end of the adjustment slot 502 proximate the distal end portion 506 of the adjustable eyelet 500.

Changing the positioning of the adjustable eyelet 500 between the extended position and the retracted position changes the overall length of the looper thread path 50 (including the length of the portion of the looper thread path between the distal end of the adjustable eyelet and the previous stitch, which extends through the looper arm 201), and changes the angle of the looper thread path 50 defined between the first direction extending parallel to the planar medial portion 501 of the adjustable eyelet 500 and the second direction extending from the distal guide hole 504 to the looper mechanism 200. These changes in looper thread path length and angle may cause a change in back-tension on the looper thread. Thus, decreasing the back-tension on the looper thread by moving the adjustable eyelet 500 toward the retracted position to decrease the looper thread path length may enable the sewing machine 10 to effectively implement a longer stitch length by minimizing potentially detrimental effects of high looper thread tension that could lead to broken looper threads and/or bunched material. Moreover, increasing the back-tension on the looper thread by moving the adjustable eyelet 500 toward the extended position to increase the looper thread path length may enable the sewing machine 10 to effectively implement a shorter stitch length by minimizing potentially detrimental effects of low looper thread tension that could lead to excessive looper thread drape or slack between the previously formed stitch and the looper arm 201 which may ultimately sway and/or whip and thus impact the positioning of the looper thread during lock stitch formation. For example, providing a longer looper thread path 50 may provide a decreased thread slack and/or drape (the distance between a theoretical linear thread path and the maximum amount of thread drape or sag of the looper thread), which may impede excessive swaying or whipping of the thread relative to the various components of the looper mechanism 200.

The adjustable eyelet 500 may be adjusted between the extended position and the retracted position by at least partially loosening the one or more fasteners 510 (e.g., at least partially unscrewing the one or more fasteners 510) to enable the adjustable eyelet 500 to slide relative to the one or more fasteners 510. Once the adjustable eyelet 500 is positioned as desired, the one or more fasteners 510 are tightened to secure the adjustable eyelet 500 in the desired position.

CONCLUSION

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A sewing machine stitch length adjustment mechanism comprising:

a multi-bar linkage operatively secured to a feed dog movement mechanism, wherein the multi-bar linkage is configured to control a feed dog movement path length, and wherein the multi-bar linkage comprises:

a first bar having an adjustable effective length between an anchor point and a pivot point, wherein the pivot point is defined as a part of a slider that is movable relative to a sidewall of the first bar; and a second bar extending between the pivot point and the feed dog movement mechanism; and wherein the first bar comprises a retaining spring configured to contact the slider and frictionally secure the slider between the retaining spring and the sidewall of the first bar to retain a selected location of the pivot point relative to the anchor point.

2. The sewing machine stitch length adjustment mechanism of claim 1, wherein the first bar comprises a rack and pinion adjustment mechanism comprising a gear rack and a rotatable pinion, wherein the rack and pinion adjustment mechanism is configured to adjust the location of the pivot point relative to the anchor point.

3. The sewing machine stitch length adjustment mechanism of claim 2, wherein the first bar comprises:

a rigid bar member defining the sidewall of the first bar on a first side of a slot defined in the rigid bar and having the gear rack defined on the first side of the slot;

a slider configured for movement within the slot, the slider having the pivot point secured thereto and having the rotatable pinion configured to engage the gear rack on the first side of the slot; and wherein rotation of the rotatable pinion relative to the gear rack causes the slider to move along a length of the slot.

4. The sewing machine stitch length adjustment mechanism of claim 3, wherein the retaining spring is secured relative to a second side of the slot, wherein the retaining spring is configured to apply a retaining force to engage the slider with the first side of the slot.

5. The sewing machine stitch length adjustment mechanism of claim 4, wherein the retaining spring is configured to adjustably secure the slider in a particular position within the slot.

6. The sewing machine stitch length adjustment mechanism of claim 3, wherein the first bar additionally comprises a locking fastener configured to selectably secure the slider in a particular position within the slot.

7. The sewing machine stitch length adjustment mechanism of claim 1, wherein the location of the pivot point relative to the anchor point is infinitely adjustable between a first position corresponding to a first stitch length and a second position corresponding to a second stitch length, the second stitch length being shorter than the first stitch length.

8. The sewing machine stitch length adjustment mechanism of claim 1, wherein the sidewall of the first bar defines a first sidewall of a slot within a rigid bar of the first bar and wherein the slot within the rigid bar additionally defines a second sidewall of the slot that is opposite the first sidewall of the slot; and the retaining spring is a leaf spring secured relative to the second sidewall of the slot and is configured to apply a compressive force to the slider to frictionally secure the slider between the retaining spring and the sidewall of the rigid bar.

9. The sewing machine stitch length adjustment mechanism of claim 1, wherein the slider is a slider block and at least a portion of the pivot point is rotatable relative to the slider block.

* * * * *